US007303457B2

(12) United States Patent
Enomoto et al.

(10) Patent No.: US 7,303,457 B2
(45) Date of Patent: Dec. 4, 2007

(54) METHOD OF BONDING DISPLAY SUBSTRATES BY APPLICATION OF AN ELECTRIC CURRENT TO HEAT AND MELT A BONDING MATERIAL

(75) Inventors: Takashi Enomoto, Fukaya (JP); Akiyoshi Yamada, Fukaya (JP); Masahiro Yokota, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/510,643

(22) Filed: Aug. 28, 2006

(65) Prior Publication Data

US 2007/0065965 A1 Mar. 22, 2007

Related U.S. Application Data

(63) Continuation of application No. PCT/JP2005/003339, filed on Feb. 28, 2005.

(30) Foreign Application Priority Data

Mar. 2, 2004 (JP) ..... 2004-057954
Mar. 10, 2004 (JP) ..... 2004-068056

(51) Int. Cl.
*H01J 9/24* (2006.01)
*H01J 9/40* (2006.01)

(52) U.S. Cl. ..... 445/25; 445/24; 65/36; 65/40; 65/58

(58) Field of Classification Search ..... 313/495–497; 445/24, 25; 65/36, 58, 40
See application file for complete search history.

(56) References Cited

U.S. PATENT DOCUMENTS 6,717,052 B2 * 4/2004 Wang et al. ..... 313/512
6,847,428 B1 * 1/2005 Sekiguchi et al. ..... 349/139
7,247,072 B2 * 7/2007 Yokota et al. ..... 445/25
2003/0147038 A1 8/2003 Lee et al.
2004/0080261 A1 4/2004 Yokota et al.
2005/0179360 A1 * 8/2005 Okamoto et al. ..... 313/495

FOREIGN PATENT DOCUMENTS

| | | | |
|---|---|---|---|
| EP | 1389792 | A1 * | 2/2004 |
| JP | 2000-251651 | A | 9/2000 |
| JP | 2002-319346 | A | 10/2002 |
| JP | 2003-68238 | A | 3/2003 |
| JP | 2003-242913 | A | 8/2003 |
| JP | 2003-272526 | A | 9/2003 |
| TW | 515062 | | 12/2002 |
| WO | WO 00/79338 | A1 | 12/2000 |
| WO | WO 2004008471 | A1 * | 1/2004 |

* cited by examiner

*Primary Examiner*—Mariceli Santiago
(74) *Attorney, Agent, or Firm*—Oblon, Spivak, McClelland, Maier & Neustadt, P.C.

(57) ABSTRACT

After sealing layers are formed on peripheral edge parts of a front substrate and a rear substrate, the front substrate and the rear substrate are disposed to be opposed to each other. Current paths are formed in the sealing layers, and power supply is begun. An electric current, which reaches a maximum current value after a current-increasing period of 10% or more of an entire power-supply time, is supplied for a perdetermined time period. The sealing layers are heated and melted by the power supply, and peripheral parts of the front substrate and rear substrate are joined.

8 Claims, 14 Drawing Sheets

METHOD OF BONDING DISPLAY SUBSTRATES BY APPLICATION OF AN ELECTRIC CURRENT TO HEAT AND MELT A BONDING MATERIAL

CROSS-REFERENCE TO RELATED APPLICATIONS

This is a Continuation Application of PCT Application No. PCT/JP2005/003339, filed Feb. 28, 2005, which was published under PCT Article 21(2) in Japanese.

This application is based upon and claims the benefit of priority from prior Japanese Patent Applications No. 2004-057954, filed Mar. 2, 2004; and No. 2004-068056, filed Mar. 10, 2004, the entire contents of both of which are incorporated herein by reference.

BACKGROUND OF THE INVENTION

1. Field of the Invention

The present invention relates to a manufacturing method and a manufacturing apparatus for a flat image display device including a pair of substrates which are opposed to each other and are attached to each other at their peripheral edge parts.

2. Description of the Related Art

In recent years, various image display devices have been developed as next-generation light-weight, small-thickness display devices, which will take the place of cathode-ray tubes (hereinafter, referred to as CRTs). Such image display devices include liquid crystal displays (LCDS) which control the intensity of light by making use of alignment of liquid crystal, plasma display panels (PDPs) which cause phosphors to emit light by ultraviolet of plasma discharge, field emission displays (FEDs) which cause phosphors to emit light by electron beams of field-emission-type electron emitting elements, and surface-conduction electron-emitter displays (SEDs) which cause phosphors to emit light by electron beams of surface-conduction-type electron emitting elements.

The FED or SED, for example, generally comprises a front substrate and a rear substrate that are opposed to each other across a predetermined gap. These substrates have their respective peripheral portions joined together by a sidewall in the form of a rectangular frame, thereby forming a vacuum envelope. A phosphor screen is formed on the inner surface of the front substrate. Provided on the inner surface of the rear substrate are a large number of electron emitting elements for use as electron emission sources, which excite the phosphors to luminescence.

A plurality of support members are provided between the rear substrate and the front substrate in order to support an atmospheric-pressure load acting on these substrates. The rear substrate-side potential is substantially set at a ground potential, and an anode voltage is applied to the phosphor surface. Electron beams, which are emitted from the electron emitting elements, are applied to red, green and blue phosphors of the phosphor screen, and cause the phosphors to emit light. Thereby, an image is displayed.

According to the FED or SED constructed in this manner, the thickness of the display device can be reduced to about several millimeters, so that the device can be made lighter in weight and thinner than CRTs that are used as displays of existing TVs or computers.

For the FED, for example, various manufacturing methods have been examined to join the front substrate and the rear substrate that constitute the envelope by means of the sidewall in the form of a rectangular frame. In general, a sintering material such as frit glass is filled between the two substrates and the side wall, and the sintering material is heated and sintered in a furnace. Thus, the substrates and the side wall are coupled to form the envelope. In an example of the basic procedure, a structure, in which the rear substrate and side wall are coupled by fusion, is prepared in advance, and the front substrate is joined to this structure.

However, when frit glass is sintered, unnecessary gas is produced. The gas remains in the sealed envelope after fusion, and the gas causes a problem when the inside of the envelope is evacuated later to a high vacuum level. Jpn. Pat. Appln. KOKAI Publication No. 2002-319346, for instance, discloses another method. In this method, a low-melting-point sealing material, such as indium, is filled between the front substrate and rear substrate. Then, current is supplied to the sealing material in a vacuum apparatus, and the sealing material itself is heated and melted by the resulting Joule heat to seal substrates together (hereinafter referred to as "electric heating"). According to this method, only the sealing material can be heated up to high temperatures and melted. Thus, a long time is not needed to heat and cool the substrates, and the substrates can be joined to form the envelope in a short time.

In the case of the electric heating, however, it is necessary to supply current so as to stably melt the sealing material. If the sealing material is not stably melted, the time for melting the sealing material varies from envelope to envelope, and stable coupling of the substrates cannot be carried out. If the electrically conductive sealing material is excessively heated, such problems arise that the sealing material may be broken due to heat or a crack may occur in the substrates. Conversely, if the sealing material is not sufficiently melted, the coupling of the substrates becomes deficient, and such problems arise that the air-tightness for maintaining vacuum deteriorates or the vacuum state of the envelope cannot be kept. Under the circumstances, in the prior art, a DC current of 100 A is supplied to the entire sealing material, and heating/melting is carried out for about one minute. Thereby, the sealing material is stably melted. On the other hand, 10 to 20 minutes are needed for cooling. In order to improve mass-productivity, there has been a demand for a further decrease in sealing time.

Although the time for melting and cooling the electrically conductive sealing material can be reduced by increasing the value of the constant current, the increase in current value leads to frequent occurrence of sparks between the sealing material and the electrode, between the electrode and the apparatus-side electrode contact, or between the sealing layers, and there arises the problem that the sealing layer cannot stably be melted.

In addition, in the above-described manufacturing method, only one side of the substrate, to which the indium is applied, is heated by the power-supply heating, resulting in a difference in temperature between the front and back surfaces of the substrate. Consequently, such a warp occurs on the substrate that the surface, on which the indium is applied, becomes convex. In this case, after cooling, the corner portions of the envelope become thicker than the central parts of the side portions of the envelope. If the envelope becomes partly thick, such problems arise that the air-tightness for vacuum deteriorates, the relative position between the electron source and phosphor layer is displaced at the corner part, and the envelope cannot easily be attached to the cabinet.

BRIEF SUMMARY OF THE INVENTION

The present invention has been made in consideration of the above-described problems, and the object of the invention is to provide a manufacturing method for an image display device, which enables a quick and stable sealing work of an electrically conductive sealing material.

According to an aspect of the invention, there is provided a method of manufacturing an image display device having an envelope including a front substrate and a rear substrate, the method comprising: forming a sealing layer by disposing an electrically conductive sealing material on a peripheral edge part of at least one of the front substrate and the rear substrate; disposing the front substrate and the rear substrate such that the front substrate and the rear substrate are opposed to each other; forming a current path in the sealing layer, beginning power supply to the sealing layer, and supplying an electric current, which reaches a maximum current value after a current-increasing period of 10% or more of an entire power-supply time, for a predetermined time period; and heating and melting the sealing layer by the electric current supply and bonding the peripheral parts of the front and rear substrates together with the molten sealing layer.

According to another aspect of the invention, there is provided a method of manufacturing an image display device having an envelope including a front substrate and a rear substrate, the method comprising: forming a sealing layer by disposing an electrically conductive sealing material on a peripheral edge part of at least one of the front substrate and the rear substrate; attaching to the sealing layer a pair of electrodes which supply power for heating and melting the sealing layer, and forming a current path for the power supply in the sealing layer; disposing the front substrate and the rear substrate such that the front substrate and the rear substrate are opposed to each other, and pressing the front substrate and the rear substrate toward each other; beginning power supply to the sealing layer via the electrodes in the state in which the front substrate and the rear substrate are pressed; supplying an electric current, which reaches a maximum current value after a current-increasing period of 10% or more of an entire power-supply time, for a predetermined time period; and heating and melting the sealing layer by the power supply to bond a peripheral part of the front substrate and a peripheral part of the rear substrate to each other.

According to another aspect of the invention, there is provided a method of manufacturing an image display device having an envelope including a front substrate and a rear substrate which are disposed to be opposed to each other and are joined at peripheral parts thereof, the method comprising: forming sealing layers on the front substrate and the rear substrate by disposing electrically conductive sealing materials on peripheral edge parts of mutually opposed surfaces of the front substrate and the rear substrate; attaching, to each of the sealing layer of the front substrate and the sealing layer of the rear substrate, a pair of electrodes which supply power for heating and melting the associated sealing layer, and forming current paths for the power supply in the sealing layer of the front substrate and the sealing layer of the rear substrate; beginning power supply to the sealing layers via the electrodes, and supplying an electric current, which reaches a maximum current value after a current-increasing period of 10% or more of an entire power-supply time, for a predetermined time period; heating and melting the sealing layer of the front substrate and the sealing layer of the rear substrate by the power supply; pressing the front substrate and the rear substrate toward each other in the state in which the front substrate and the rear substrate are opposed to each other; and bonding the peripheral parts of the front substrate and rear substrates to each other.

According to the manufacturing method for the image display device with the above structure, an electric current, which has such a gentle curve that the current reaches a maximum current value after a current-increasing period of 10% or more of the entire power-supply time, is supplied to the electrically conductive sealing material for a predetermined time period, thus heating/melting the sealing material and carrying out the sealing process. Thereby, the maximum current value for heating/melting is set at a value twice as high as a value in the prior art. Hence, even in the case where the power-supply time for heating is reduced, the occurrence of spark can surely be avoided, and the current can stably be supplied to the sealing layer. Thereby, the sealing layer can be formed with uniform thickness over the entire periphery, and the sealing work can stably be performed in a short time while the entire substrate is kept at low temperatures.

According to still another aspect of the invention, there is provided a method of manufacturing an image display device having an envelope including a first substrate and a second substrate which are opposed to each other with a gap and are joined at peripheral parts thereof, a sealing layer which is disposed along a peripheral edge part on an inner surface of at least one of the first substrate and the second substrate and contains an electrically conductive material, and a plurality of pixels provided within the envelope, the method comprising:

forming a sealing layer by disposing an electrically conductive sealing material along a peripheral edge part on an inner surface of at least one of the first substrate and the second substrate; disposing the first substrate and the second substrate such that the first substrate and the second substrate are opposed to each other in a state in which one of the first substrate and the second substrate is supported, and then supplying power to the sealing layer to heat and melt the sealing material and sealing together peripheral parts of the first and second substrates; and pushing corner portions of the other of the first and second substrates toward the one of the first and second substrates during or after the power supply to correct warp of the substrate.

According to an aspect of the invention, there is provided an apparatus for manufacturing an image display device having an envelope including a first substrate and a second substrate which are disposed to be opposed to each other with a gap and are coupled at peripheral parts thereof, a sealing layer which is disposed along a peripheral edge part on an inner surface of at least one of the first substrate and the second substrate and contains an electrically conductive material, and a plurality of pixels provided within the envelope, the apparatus comprising:

a support mechanism which supports the first substrate and the second substrate that are opposed to each other, in a state in which one of the first and second substrates is supported; a power-supply mechanism which supplies power to the sealing layer disposed on said at least one of the substrates; and a pushing mechanism which pushes corner portions of the other of the first and second substrates toward the one of the substrates to correct warp of the substrate.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
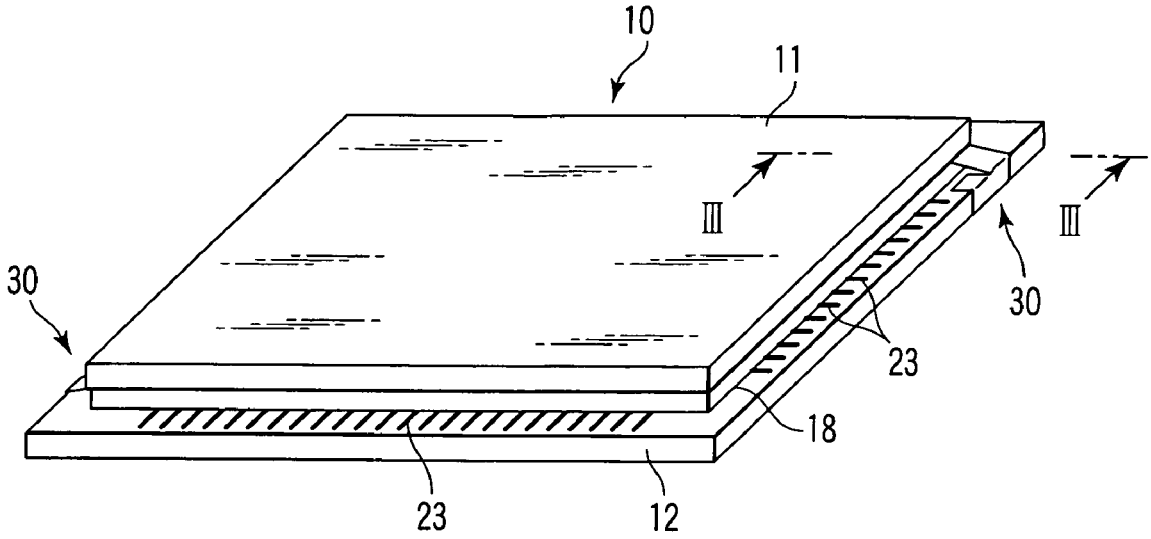
FIG. 1 is a perspective view showing the entirety of an FED which is manufactured by a manufacturing method according to a first embodiment of the present invention.

An FED, which is an image display device, and a manufacturing method of the FED according to a first embodiment of the present invention will now be described in detail with reference to the accompanying drawings.

As shown in FIG. 1 to FIG. 4, the FED includes a front substrate 11 and a rear substrate 12, each of which is formed of a rectangular glass plate. The front substrate 11 and rear substrate 12 are disposed to be opposed to each other with a gap of 1 to 2 mm. The rear substrate 12 has a greater size than the front substrate 11. Peripheral edge parts of the front substrate 11 and rear substrate 12 are attached via a rectangular-frame-shaped side wall 18, thereby forming a flat, rectangular vacuum envelope 10 in which a vacuum is maintained.

A plurality of plate-shaped support members 14 are provided within the vacuum envelope 10 in order to support an atmospheric pressure load acting on the front substrate 11 and rear substrate 12. The support members 14 extend in a direction parallel to one side of the vacuum envelope 10, and are arranged at predetermined intervals in a direction perpendicular to the one side of the vacuum envelope 10. The support members 14 are not limited to plate-shaped ones, and may be columnar ones.

Figure 3:
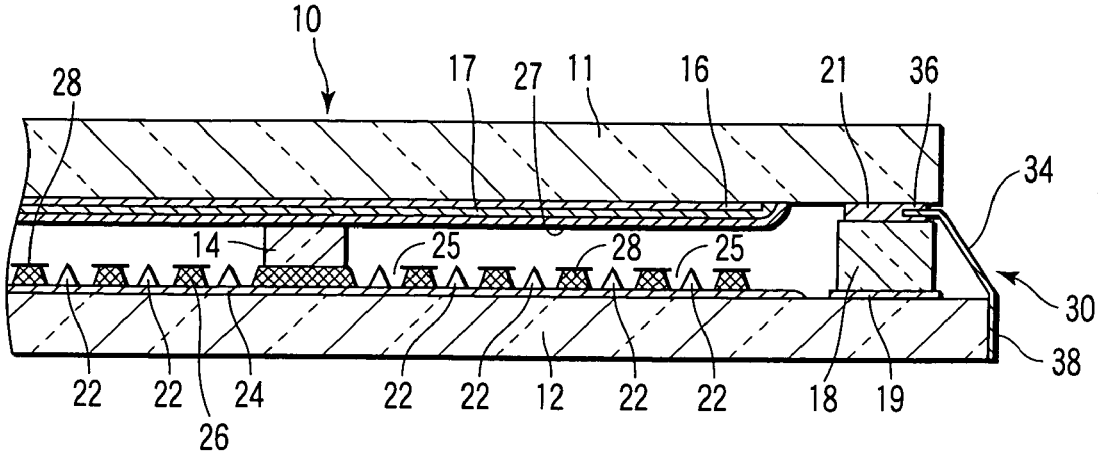
FIG. 3 is a cross-sectional view taken along line III-III in FIG. 1.
Figure 4:
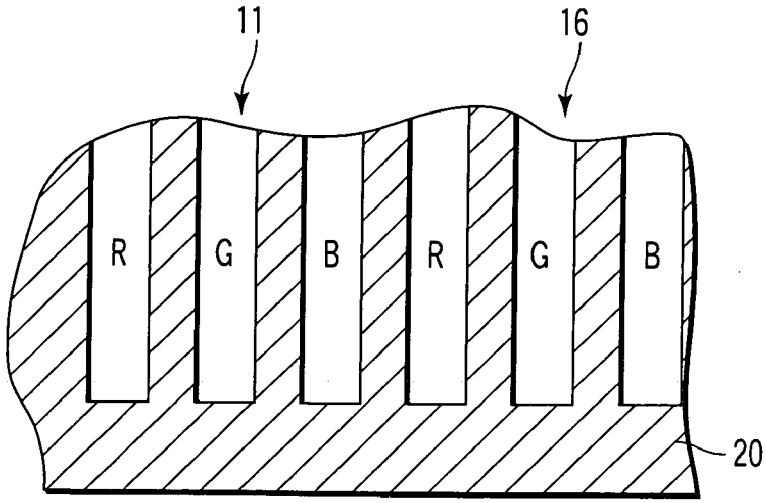
FIG. 4 is a plan view showing, in enlarged scale, a part of a phosphor screen of the FED.

A phosphor screen 16 which functions as an image display surface is formed on the inner surface of the front substrate 11. As shown in FIG. 4, the phosphor screen 16 is constructed by arranging red, green and blue phosphor layers R, G and B and a black light absorption layer 20 which is located between these phosphor layers. The phosphor layers R, G and B extend in a direction parallel to the one side of the vacuum envelope 10, and are arranged at predetermined intervals along a direction perpendicular to the one side of the vacuum envelope 10. As shown in FIG. 3, a metal back 17 formed of, e.g. aluminum, and a getter film 27 formed of, e.g. barium are successively stacked on the phosphor screen 16.

A number of electron emitting elements 22, which emit electron beams, are provided on the inner surface of the rear substrate 12 as electron emitter sources for exciting the phosphor layers of the phosphor screen 16. These electron emitting elements 22 are arranged in columns and rows in association with pixels. Specifically, an electrically conductive cathode layer 24 is formed on the inner surface of the rear substrate 12, and a silicon dioxide film 26 having many cavities 25 are formed on this electrically conductive cathode layer. Gate electrodes 28 which are formed of, e.g. molybdenum or niobium are formed on the silicon dioxide film 26. Conical electron emitting elements 22, which are formed of, e.g. molybdenum, are provided in the cavities 25 on the inner surface of the rear substrate 12. As shown in FIG. 1, many wiring lines 23 for supplying potential to the electron emitting elements 22 are provided in a matrix on the inner surface of the rear substrate 12, and end portions thereof are led out to the peripheral edge part of the vacuum envelope 10.

In the FED with the above-described structure, video signals are input to the electron emitting elements 22 and gate electrodes 28 which are formed in a simple matrix scheme. When the electron emitting elements 22 are regarded as a reference, a gate voltage of +100 V is applied at a time of maximum luminance. In addition, a voltage of +10 kV is applied to the phosphor screen 16. Thereby, electron beams are emitted from the electron emitting elements 22. The magnitude of electron beams from the electron emitting elements 22 is modulated by the voltage of the gate electrodes 28. The electron beams excite the phosphor layers of the phosphor screen 16 and cause the phosphor layers to emit light, thereby displaying an image.

Since a high voltage is applied to the phosphor screen 16, as described above, a high-strain-point glass is used as plate glasses for the front substrate 11, rear substrate 12, side wall 18 and support members 14. As will be described later, the rear substrate 12 and side wall 18 are sealed together by a low-melting-point glass 19 such as frit glass. The front substrate 11 and side wall 18 are sealed together by a sealing layer 21 including indium (In) as an electrically conductive low-melting-point sealing material.

The FED includes a plurality of, for example, a pair of electrodes 30. These electrodes are attached to the envelope 10 in a state in which the electrodes are electrically connected to the sealing layer 21. These electrodes 30 are used as electrodes for supplying power to the sealing layer 21.

Figure 2:
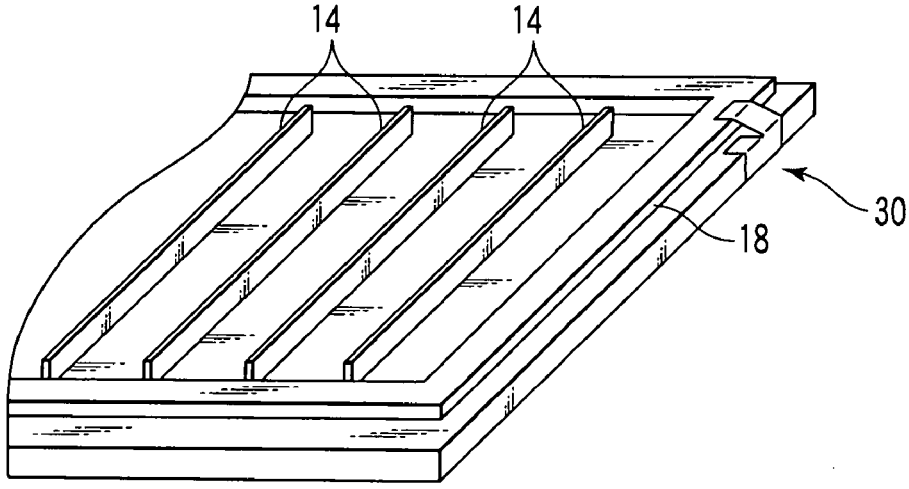
FIG. 2 is a perspective view showing an internal structure of the FED.
Figure 5:
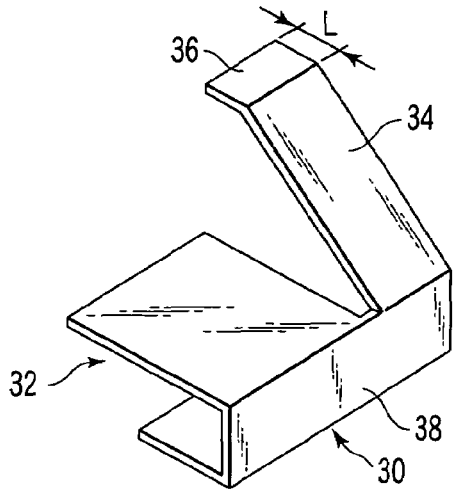
FIG. 5 is a perspective view of an electrode of the FED.

As shown in FIG. 2, FIG. 3 and FIG. 5, each of the electrodes 30 is formed by bending a copper plate with a thickness of, e.g. 0.2 mm as an electrically conductive member. Specifically, the electrode 30 is bent in a substantially U-shaped cross section, and integrally comprises a mounting portion 32, a body portion 34 which extends from the mounting portion and serves as a current path to the sealing layer, a contact portion 36 which is located at an extension end of the body portion and is capable of contacting the sealing layer, and a flat electrically conductive portion 38 which is formed of back surface parts of the mounting portion and body portion. The mounting portion 32 integrally includes a clamping portion which is bent in a clip-like shape. The mounting portion 32 clamps a peripheral edge part of the front substrate 11 or rear substrate 12, and thus can be attached thereto. A horizontal extension length L of the contact portion 36 is set at 2 mm or more. The body portion 34 is formed in a strip shape and extends obliquely upward from the mounting portion 32. Thus, the contact portion 36 is positioned higher than the mounting portion 32 and body portion 34 in the vertical direction.

As shown in FIG. 1 to FIG. 3, each electrode 30 is attached in a state in which the electrode 30 is resiliently engaged with, for example, the rear substrate 12 of the vacuum envelope 10. Specifically, each electrode 30 is fitted to the vacuum envelope 10 in a state in which the peripheral part of the rear substrate 12 is resiliently clamped by the mounting portion 32. The contact portion 36 of each electrode 30 is electrically connected to the sealing layer 21. The body portion 34 extends outward of the vacuum envelope 10 from the contact portion 36, and the electrically conductive portion 38 is opposed to the side surface of the rear substrate 12 and is exposed to the outer surface of the vacuum envelope 10. The paired electrodes 30 are provided at two diagonally spaced-apart corners of the vacuum envelope 10 and are disposed symmetric with respect to the sealing layer 21.

Next, a method of manufacturing the FED with the above-described structure is described in detail.

To start with, the phosphor screen 16 is formed on a plate glass which becomes the front substrate 11. Specifically, a plate glass having the same size as the front substrate 11 is prepared, and a phosphor stripe pattern is formed on the plate glass by a plotter machine. The plate glass, on which the phosphor stripe pattern is formed, and the plate glass for the front substrate are placed on a positioning jig and are set on an exposure table. In this state, exposure and development are carried out to form the phosphor screen on the glass plate which becomes the front substrate 11. Then, a metal back 17 is laid over the phosphor screen 16.

Subsequently, the electron emitting elements 22 are formed on the plate glass for the rear substrate 12. Specifically, a matrix-shaped electrically conductive cathode layer 24 is formed on the plate glass. An insulation film of a silicon dioxide film is formed on the cathode layer by, e.g. thermal oxidation, CVD or sputtering. On this insulation film, a metal film of, e.g. molybdenum or niobium for forming gate electrodes is formed by, e.g. sputtering or electron-beam evaporation deposition. Then, a resist pattern, which has a shape corresponding to gate electrodes to be formed, is formed on the metal film by lithography. Using the resist pattern as a mask, the metal film is etched by wet etching or dry etching, and the gate electrodes 28 are formed.

Thereafter, using the resist pattern and the gate electrodes 28 as a mask, the insulation film is etched by wet etching or dry etching, and thus cavities 25 are formed. After the resist pattern is removed, electron-beam evaporation deposition is carried out on the surface of the rear substrate 12 in an inclined direction at a predetermined angle. Thereby, a peeling layer of, e.g. aluminum or nickel is formed on the gate electrodes 28. Further, a material for forming cathodes, such as molybdenum, is vertically deposited on the surface of the rear substrate 12 by electron-beam evaporation deposition. Thus, the electron emitting elements 22 are formed in the cavities 25. Then, the peeling layer, together with the metal layer formed thereon, is removed by a lift-off method.

Figure 6A:
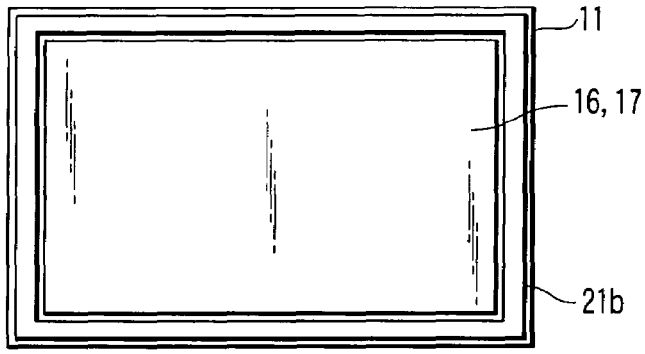
FIG. 6A is a plan view showing a front substrate which is used in the manufacture of the FED.
Figure 6B:
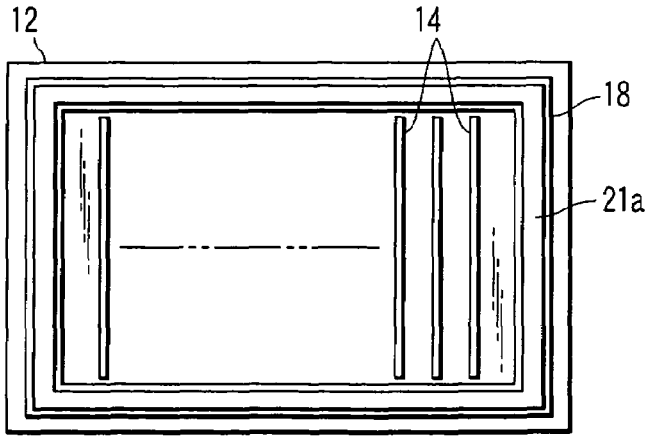
FIG. 6B is a plan view showing a rear substrate which is used in the manufacture of the FED.

Subsequently, the side wall 18 and support members 14 are sealed on the inner surface of the rear substrate 12 by a low-melting-point glass 19 in the atmospheric air. As shown in FIG. 6A and FIG. 6B, indium is coated with a predetermined width and thickness on the entire periphery of a sealing surface of the side wall 18, thereby forming a sealing layer 21*a*, and also indium is coated with a predetermined width and thickness on the entire periphery of a sealing surface of the front substrate 11, which is opposed to the sealing surface of the side wall 18, thereby forming a sealing layer 21*b*. The sealing layers 21*a* and 21*b* are applied to the sealing surfaces of the side wall 18 and front substrate 11 by, for example, a method in which molten indium is applied to the sealing surfaces, or a method in which solid indium is placed on the sealing surfaces.

Figure 7:
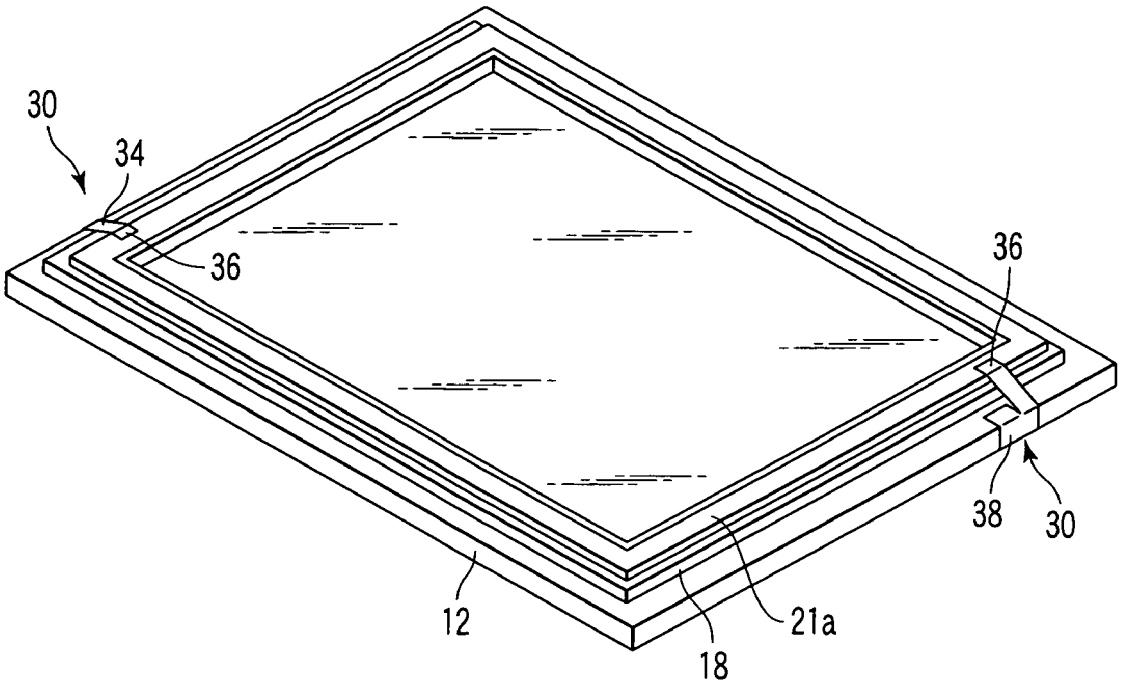
FIG. 7 is a perspective view showing a state in which electrodes are attached to the rear substrate of the FED.

Subsequently, as shown in FIG. 7, the paired electrodes 30 are attached to the rear substrate 12 to which the side wall 18 is attached. In this case, each electrode 30 is attached such that the contact portion 36 does not contact the sealing layer 21*a* and is opposed to the sealing layer with a gap. It is necessary to provide a pair of electrodes 30 with a positive (+) polarity and a negative (−) polarity on the substrate, and it is desirable to equalize the lengths of the current paths of the sealing layers 21*a* and 21*b* through which current is supplied in parallel between the paired electrodes. The paired electrodes 30 are mounted at two diagonally opposed corners of the rear substrate 12, and the lengths of the sealing layers 21*a* and 21*b*, which are positioned between the electrodes, are set to be substantially equal on both sides of each electrode.

Figure 8:
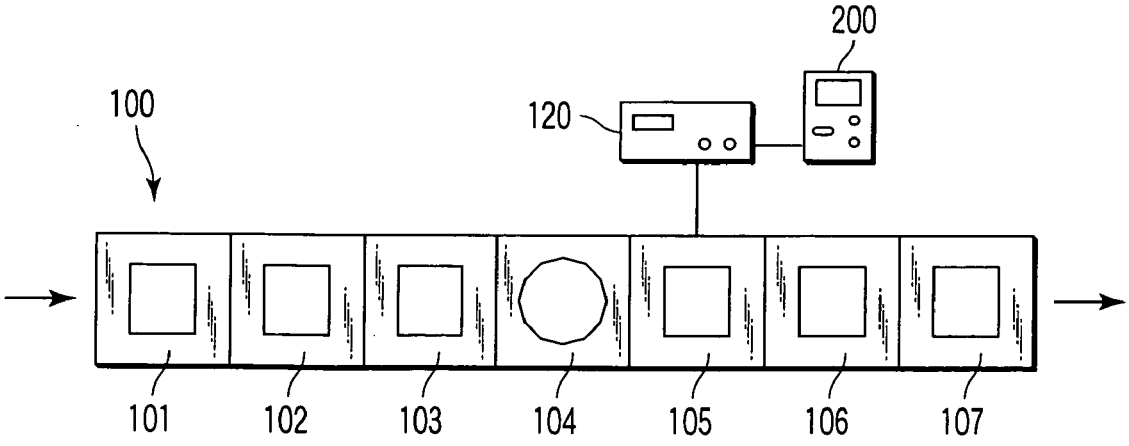
FIG. 8 schematically shows a vacuum process apparatus which is used in the manufacture of the FED.

After the electrodes 30 are mounted, the rear substrate 12 and front substrate 11 are spaced apart with a predetermined distance and are opposed. In this state, the resultant structure is put in a vacuum process apparatus. For example, a vacuum process apparatus 100 shown in FIG. 8 is used. The vacuum process apparatus 100 includes arranged chambers, that is, a load chamber 101, a baking/electron-beam cleaning chamber 102, a cooling chamber 103, a getter film evaporation deposition chamber 104, an assembly chamber 105, a cooling chamber 106, and an unload chamber 107. A power supply unit 120, which outputs a DC power for heating and melting the sealing layers 21*a* and 21*b*, and a computer 200 which controls the power supply unit 120 are connected to the assembly chamber 105. Each chamber of the vacuum process apparatus 100 is constructed as a process chamber that is capable of carrying out a vacuum process. When the FED is manufactured, all the chambers are evacuated. These process chambers are connected via gate valves, etc., which are not shown.

The front substrate 11 and rear substrate 12, which are opposed with a predetermined distance, are first introduced into the load chamber 101. After the load chamber 101 is evacuated, the front substrate 11 and rear substrate 12 are transferred to the baking/electron-beam cleaning chamber 102.

In the baking/electron-beam cleaning chamber 102, the various members are heat up to 350° C. to 400° C., and a surface-adsorbed gas on the front substrate 11 and rear substrate 12 is released. At the same time, electron beams are emitted from an electron beam generating unit (not shown), which is attached to the baking/electron-beam cleaning chamber 102, to the phosphor screen surface of the front substrate 11 and to the electron emitting element surface of the rear substrate 12. In this case, the electron beams are deflected and scanned by a deflecting device, which is mounted on the outside of the electron beam generating unit. Thereby, the entire phosphor screen surface and electron emitting element surface are subjected to electron-beam cleaning.

In the baking step, the sealing layers 21*a* and 21*b* are once melted by heat and have fluidity. However, the contact portion 36 of each electrode 30 is not in contact with the sealing layer 21*a*, 21*b*, and is opposed to the sealing layer 21*a*, 21*b* with a gap. Thus, the molten indium is prevented from flowing out of the rear substrate 12 via the electrode 30.

The front substrate 11 and rear substrate 12, which have been subjected to baking and electron-beam cleaning, are delivered to the cooling chamber 103, and cooled down to temperatures of about 120° C. Then, the front substrate 11 and rear substrate 12 are transferred to the getter film evaporation deposition chamber 104. In the evaporation deposition chamber 104, a barium film is deposited by evaporation as the getter film 27 on the outside of the metal back 17. The barium film can prevent the surface thereof from being contaminated with oxygen or carbon, and the active state can be maintained.

Figure 9:
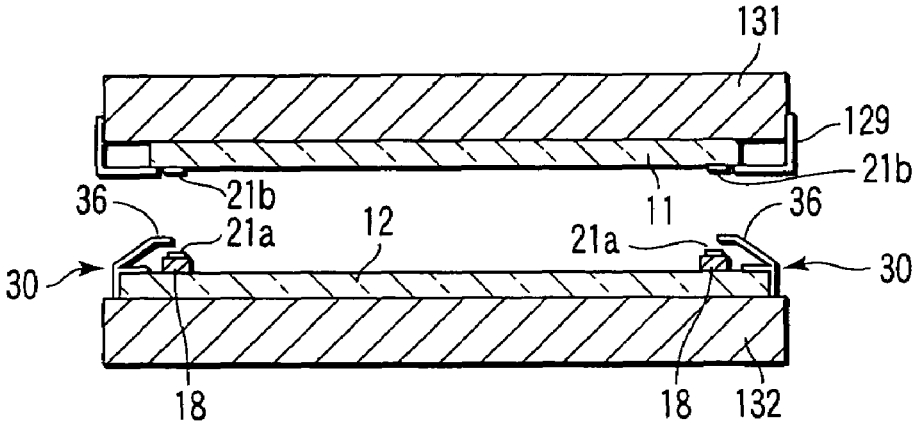
FIG. 9 is a cross-sectional view showing a state in which the rear substrate and front substrate, on which indium is disposed, are disposed to be opposed.

The front substrate 11 and rear substrate 12 are then delivered to the assembly chamber 105. As shown in FIG. 9, in the assembly chamber 105, the front substrate 11 and rear substrate 12 are disposed to be opposed to each other and are held on hot plates 131 and 132 in the assembly chamber. The front substrate 11 is fixed to the upper-side hot plate 131 by a fixing jig 129 in order to prevent the front substrate 11 from dropping.

While the temperatures of the front substrate 11 and rear substrate 12 are maintained at about 120° C., the front substrate 11 and rear substrate 12 are moved toward each other and pressed under a predetermined pressure. The substrates are moved by a method in which both the front substrate 11 and rear substrate 12 are moved toward each other, or by a method in which one of the front substrate 11 and rear substrate 12 is moved so that the front substrate 11 and rear substrate 12 approach each other.

By pressing the front substrate 11 and rear substrate 12 under a predetermined pressure, the sealing layer 21*b* on the front substrate 11 side and the sealing layer 21*a* on the rear substrate 12 side are put in contact, the contact portion 36 of each electrode 30 is clamped between the sealing layers 21*a* and 21*b*, and each electrode 30 is electrically connected to the sealing layers 21*a* and 21*b*. At this time, since the contact portion 36 has a horizontal length of 2 mm or more, the contact portion 36 can stably contact the sealing layers 21*a* and 21*b*. It is possible to coat indium on the contact portion 36 of electrode 30 in advance. In this case, better contact and electrical conduction between the contact portion 36 and the sealing layers 21*a* and 21*b* can be achieved.

Figure 10:
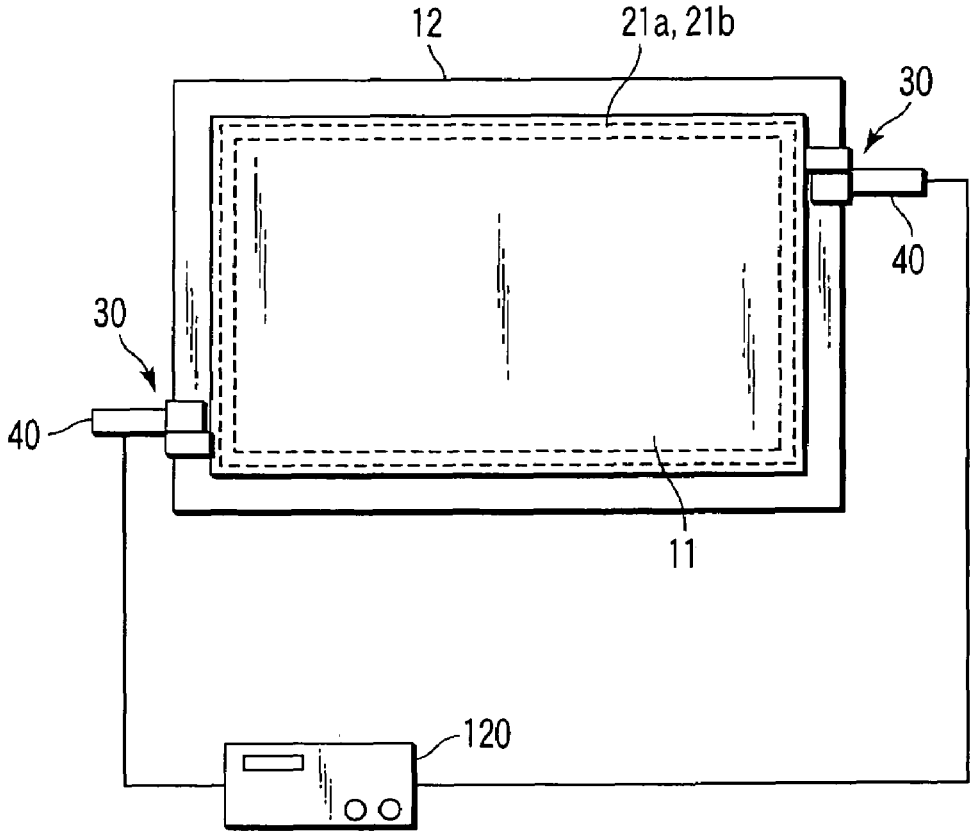
FIG. 10 is a plan view schematically showing a state in which a power supply is connected to the electrodes of the FED in the manufacturing process of the FED.

In this state, as shown in FIG. 10, power output terminals 40 of the power supply unit 120 are electrically connected to the paired electrodes 30. Then, a DC current is supplied in a constant current mode from the power supply unit 120 to the sealing layer 21*a* on the side wall 18 side, and to the sealing layer 21*b* on the front substrate 11 side. By the power supply, the sealing layers 21*a* and 21*b* are heated and the indium is melted.

In the first embodiment, at the time of heating/melting by power supply to the sealing layers 21*a* and 21*b*, an electric current, which has such a gentle curve that the current reaches a maximum current value (constant current value) after a current-increasing period of 10% or more of the entire power-supply time during a power-supply transition period, and which has a maximum current value of 200 amperes or more, is supplied for a predetermined time period, thereby heating/melting the sealing layers 21*a* and 21*b*.

Figure 11:
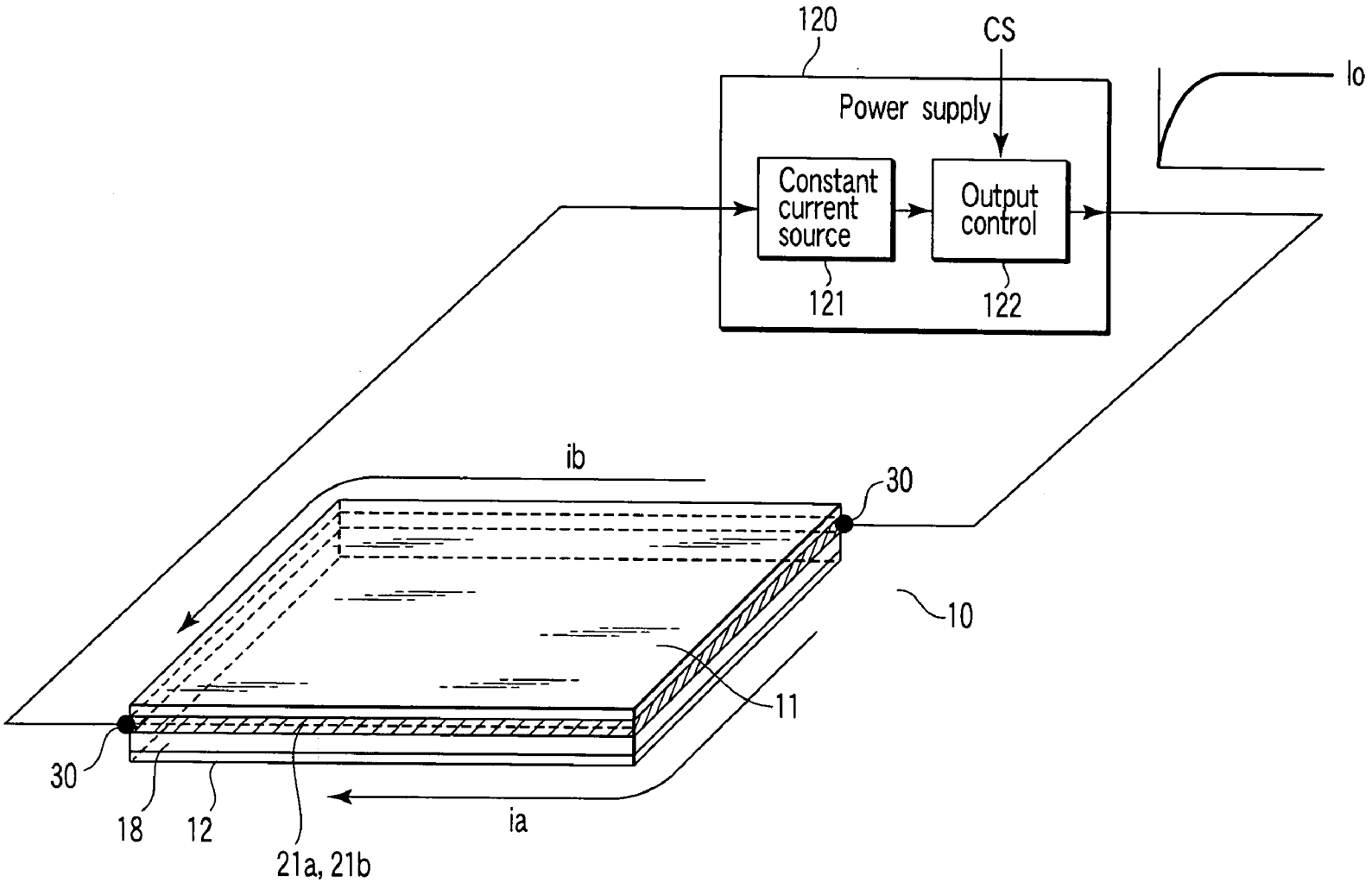
FIG. 11 is a view for describing current control means at a time of heating/melting by power supply to the sealing layer in the manufacturing process of the FED.

The heating/melting process by the power supply to the sealing layers 21*a* and 21*b* in this case is explained with reference to FIG. 11. In the power supply unit 120, a constant current source 121 generates a predetermined constant current of, e.g. about 200 to 400 amperes. A power supply output control unit 122 controls an output constant current from the constant current source 121, and has a function of controlling a transition current. In accordance with a control command CS from the computer 200 (or a pressing state detection signal of a substrate pressing mechanism in the assembly chamber 105), the power supply output control unit 122 outputs, for a predetermined time period, a current (Io) which has, as shown in the Figure, such a gentle curve that the current reaches a maximum current value (constant current period) after a current-increasing period of 10% or more of the entire power-supply time, and which has a maximum current value of 200 amperes or more. Current paths, along which current passes through the sealing layers 21*a* and 21*b* in this case, are designated by ia and ib in the Figure. In the example of the coated sealing layers in this embodiment, the sealing layer 21*b* is coated on the front substrate 11, and the sealing layer 21*a* is coated on the rear substrate 12. Thus, the output current is divided into four components, that is, currents ia and ib flowing in the sealing layer 21*a* and currents ia and ib flowing in the sealing layer 21*b*. Accordingly, if the maximum current value (Io) is 280 amperes, a 70 ampere constant current is equally supplied as each of ia and ib to the sealing layer 21*a* during a constant current period tb.

In the present embodiment, during the power-supply transition period until reaching the maximum current value (Io), the output current value is gradually increased. Thereby, occurrence of spark is prevented under the condition that the current value that is necessary for heating/melting is set at a higher value.

Figure 12A:
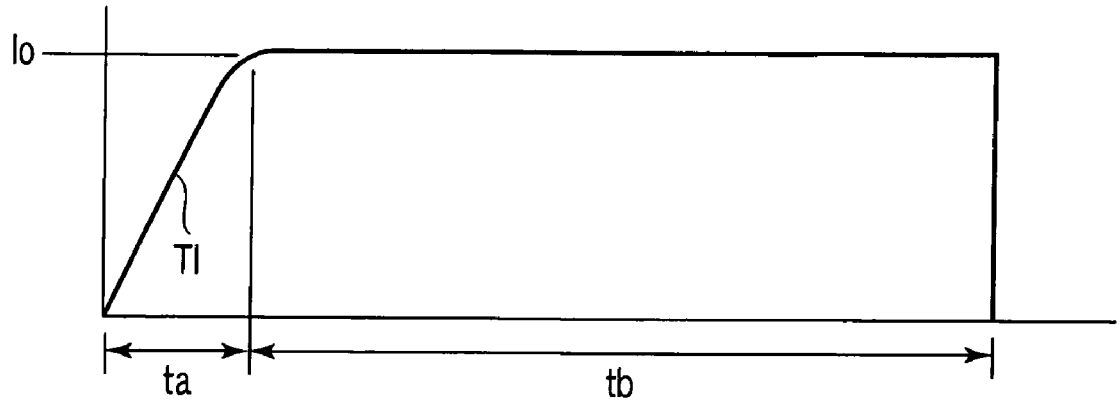
FIG. 12A is a graph showing a current waveform which is applicable at the time of heating/melting.

FIGS. 12A, 12B, 12C, and 12D show examples of the current waveform in the power-supply transition period (current-increasing period) until reaching the maximum current value (Io). In FIG. 12A, a transition current (TI) is linearly varied during the current-increasing period (ta), that is, the power-supply transition period until reaching the maximum current value (Io), that is, the constant current period (tb). The current-increasing period (ta) is set at 10% or more of the entire power-supply period (ta+tb). According to this setting, the output control unit 122 executes output control of the transition current.

Figure 12B:
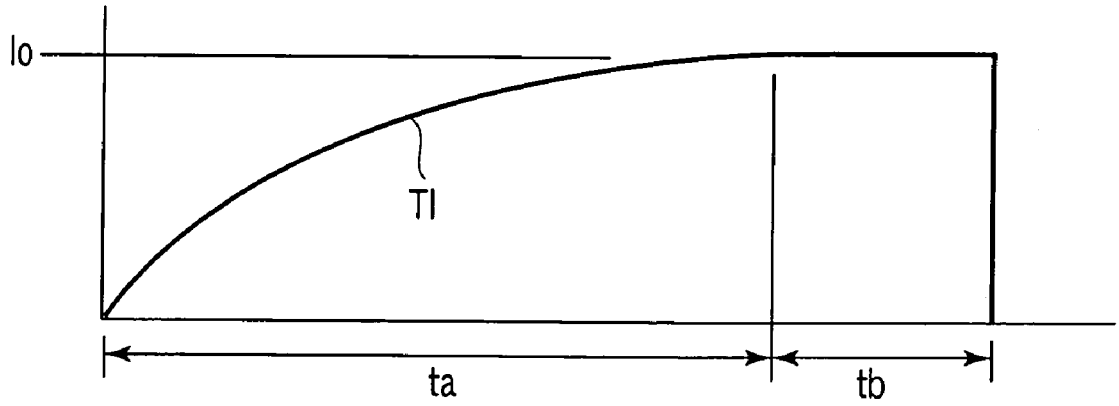
FIG. 12B is a graph showing a current waveform which is applicable at the time of heating/melting.
Figure 12C:
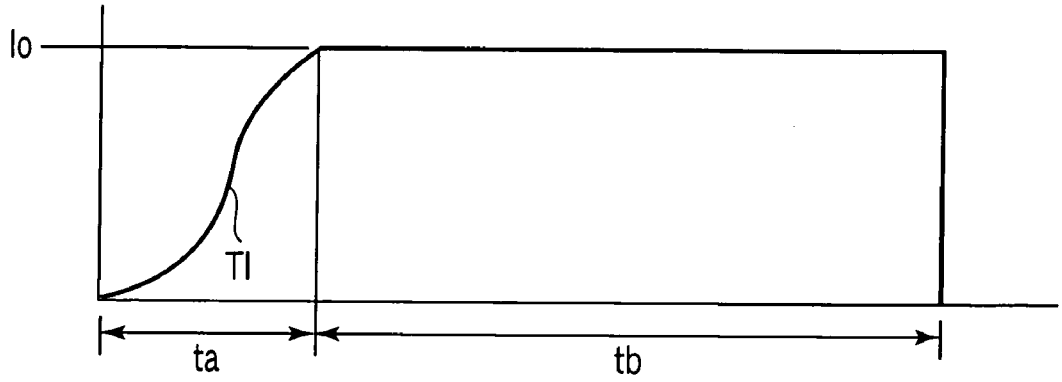
FIG. 12C is a graph showing a current waveform which is applicable at the time of heating/melting.
Figure 12D:
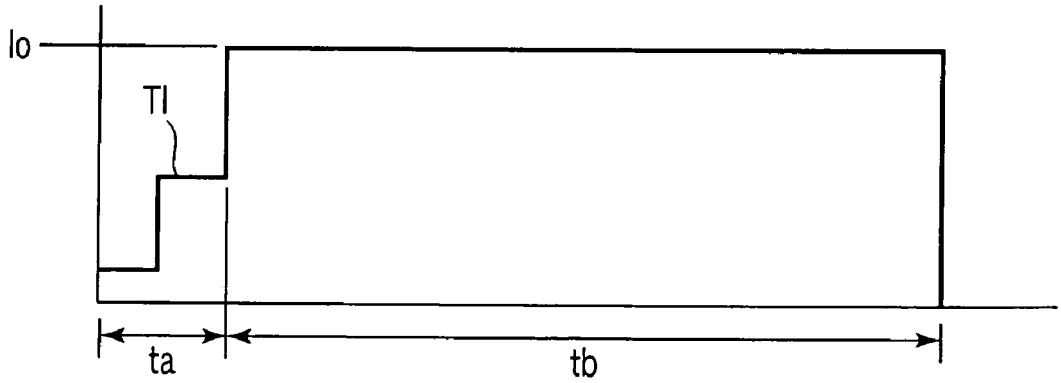
FIG. 12D is a graph showing a current waveform which is applicable at the time of heating/melting.

In the example shown in FIG. 12B, the current-increasing period (ta), that is, the power-supply transition period until reaching the maximum current value (Io), is set at 50% or more of the entire power-supply period. During this period, the transition current (TI) is varied in a curve. In the example shown in FIG. 12C, the transition current (TI) is varied in an S-curve during the current-increasing period (ta), that is, the power-supply transition period until reaching the maximum current value (Io). In the example shown in FIG. 12D, the transition current (TI) is varied stepwise during the current-increasing period (ta), that is, the power-supply transition period until reaching the maximum current value (Io).

Figure 13:
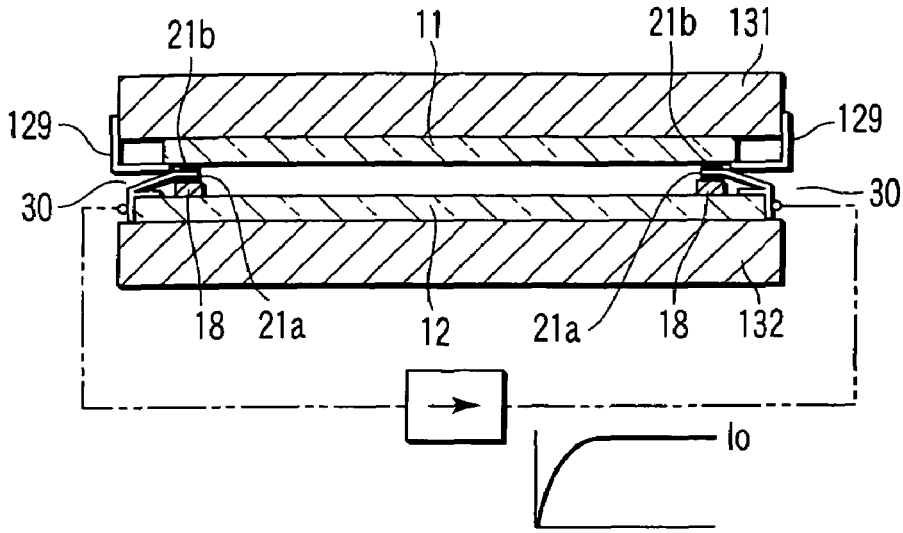
FIG. 13 shows an example of the supply of a constant current in a pressing/heating mode in the manufacturing process of the FED.
Figure 14:
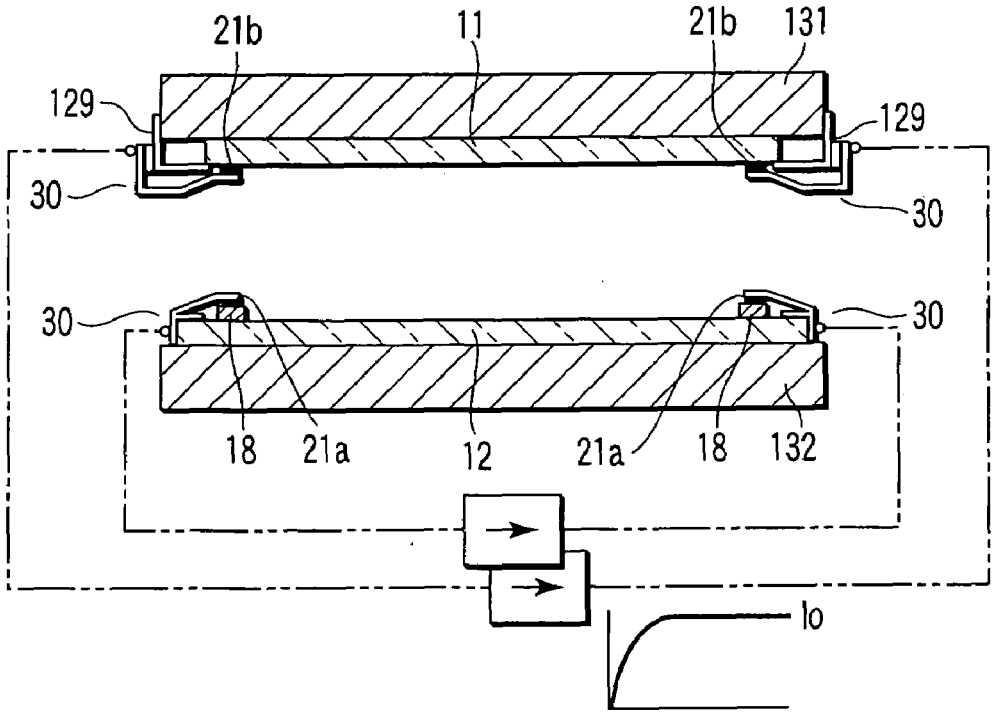
FIG. 14 shows an example of the supply of a constant current in a heating/pressing mode in the manufacturing process of the FED.

FIGS. 13 and 14 show examples of power supply in a plurality of kinds of heating/melting process modes in which the supplied current reaches the predetermined constant current value after the above-described current-increasing period (Ti). FIG. 13 shows an example of power supply of the constant current in the pressing/heating mode in which the sealing layers 21*a* and 21*b* are heated and melted in the state in which the substrates (front substrate 11 and rear substrate 12) are pressed on each other. In this case, the sealing layers 21*a* and 21*b*, which are being pressed, are heated/melted by the above-described equally divided currents from the single power supply.

FIG. 14 shows an example of power supply of the constant current in the heating/pressing mode in which the front substrate 11 and rear substrate 12 are pressed toward each other in the state in which each of the sealing layer 21*b* coated on the front substrate 11 and the sealing layer 21*a* coated on the rear substrate 12 is heated/melted. In this case, the sealing layers 21*a* and 21*b* are heated/melted in a simultaneous, parallel fashion by separate power supplies or by a single power supply.

As described above, in the assembly chamber 105, at the time of heating/melting by power supply to the sealing layers 21*a* and 21*b* coated on the front substrate 11 side and rear substrate 12 side, an electric current, which has such a gentle curve that the current reaches a maximum current value after a current-increasing period of 10% or more of the entire power-supply time, and which has a maximum current value of 200 amperes or more, is supplied for a predetermined time period, thereby heating/melting the sealing layers 21*a* and 21*b*. The peripheral part of the front substrate 11 and the side wall 18 are sealed together by the sealing layers 21*a* and 21*b* which are heated and melted.

The front substrate 11, side wall 18 and rear substrate 12, which are sealed in the above-described step, are cooled down to normal temperature in the cooling chamber 106, and are taken out from the unload chamber 107. Thereby, the vacuum envelope 10 of the FED is completely fabricated.

If necessary, the pair of electrodes 30 may be removed after the fabrication of the vacuum envelope 10 is completed.

According to the above-described manufacturing method of the FED, at the time of heating/melting by power supply to the sealing layers 21*a* and 21*b* coated on the front substrate 11 side and rear substrate 12 side, an electric current, which has such a gentle curve that the current reaches a maximum current value after a current-increasing period of 10% or more of the entire power-supply time, and which has a maximum current value of 200 amperes or more, is supplied for a predetermined time period, thereby heating/melting the sealing layers 21*a* and 21*b*. The peripheral part of the front substrate 11 and the side wall 18 are sealed together by the sealing layer 21 which is heated and melted. Thereby, the time needed for the sealing work in the manufacturing process can be reduced, and the drawback, such as spark, can be avoided and a current for stable heating/melting can be supplied to the sealing layer 21. Hence, the sealing work can be carried out in a short time period before the entire substrate is unnecessarily heated, and the sealing work can be performed efficiently and quickly. Since the electrically conductive low-melting-point sealing material, which forms the sealing layer, can stably and exactly be melted in a predetermined power-supply time, quick and exact sealing can be carried out without causing cracks, etc. in the sealing layer 21.

Therefore, the FED, which has good mass-productivity and can obtain a stable and excellent image, can be manufactured at low cost.

Figure 15:
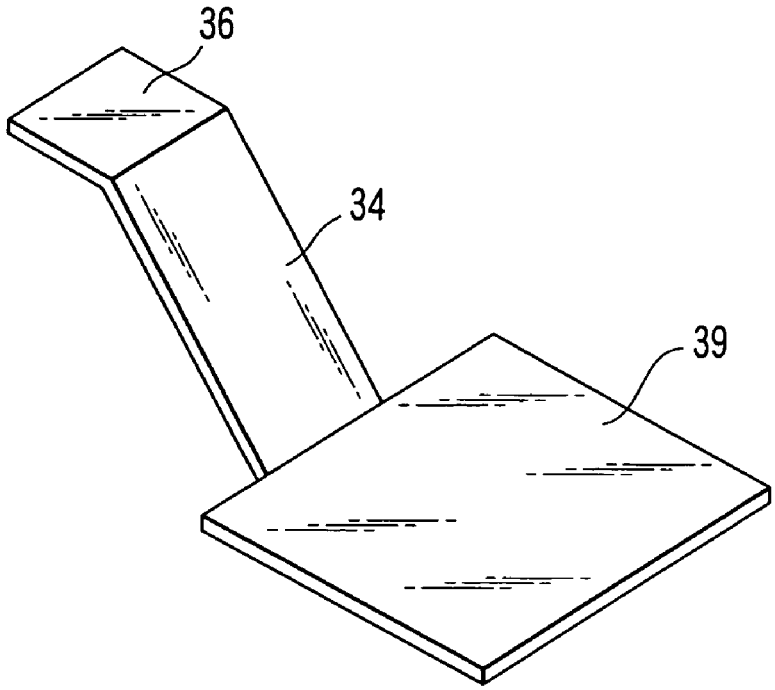
FIG. 15 is a perspective view showing another example of the structure of the electrode which is applied to the present invention.
Figure 16:
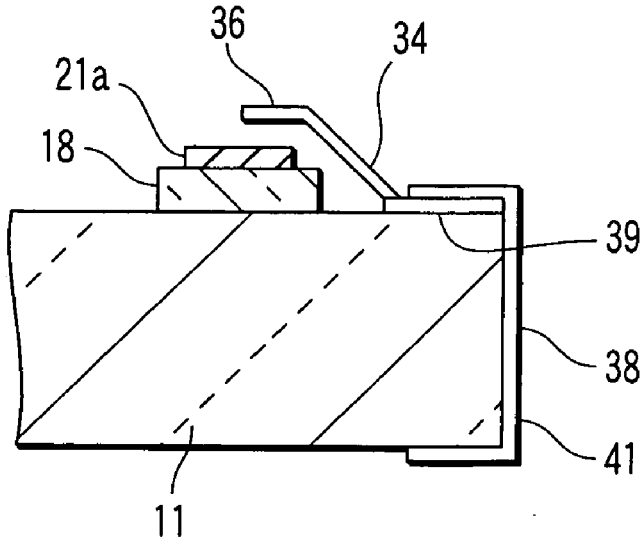
FIG. 16 is a cross-sectional view showing a state in which the electrode shown in FIG. 15 is mounted.

In the above-described embodiment, the current-increasing control at the initial stage of power supply is not limited to the examples shown in FIG. 11 to FIG. 14. Various modifications and applications can be made in the method in which current paths are formed in the sealing layer and the power supply to the sealing layer is begun, and an electric current, which reaches a maximum current value after a current-increasing period of 10% or more of the entire power-supply time, is supplied for a predetermined time period. In the embodiment, each electrode 30 integrally comprises the clip-like clamping portion functioning as the mounting portion. Alternatively, as shown in FIG. 15 and FIG. 16, each electrode 30 may include a separate clip 41 functioning as the clamping portion. Specifically, the electrode 30 includes a contact portion 36, a body portion 34 and a flat base portion 39, which are integrally formed by bending a plate material. The mounting portion of the electrode 30 is constituted by the base portion 39 and a separate clip 41. The clip 41 clamps the base portion 39 and a peripheral edge part of the substrate, that is, a peripheral edge part of the rear substrate 12 in this example, and thereby the electrode 30 is attached to the rear substrate 12.

Next, a method of manufacturing an FED, according to a second embodiment of the invention is described. In the second embodiment, the parts common to those in the first embodiment are denoted by like reference numerals, and a detailed description thereof is omitted.

To start with, like the first embodiment, the phosphor screen 16 is formed on a plate glass which becomes the front substrate 11 as a first substrate. Then, a metal back layer 17 is laid over the phosphor screen 16. The electron emitting elements 22 are formed on a plate glass for the rear substrate 12 which is a second substrate.

Figure 17A:
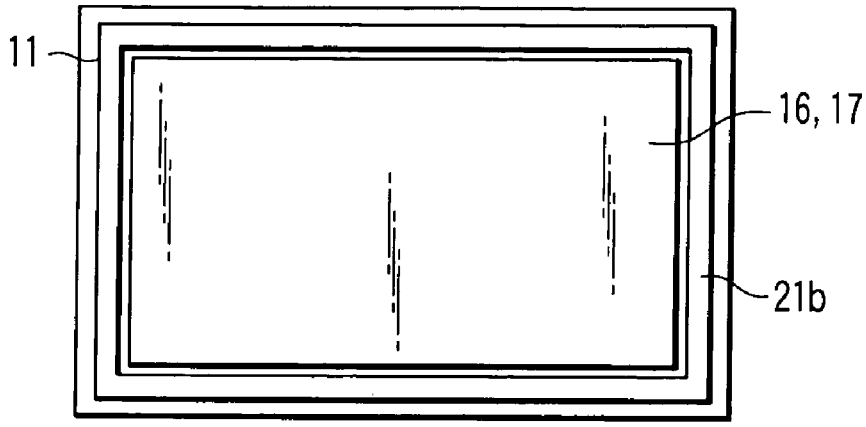
FIG. 17A is a plan view showing a front substrate which is used in the manufacture of an FED in a second embodiment of the invention.
Figure 17B:
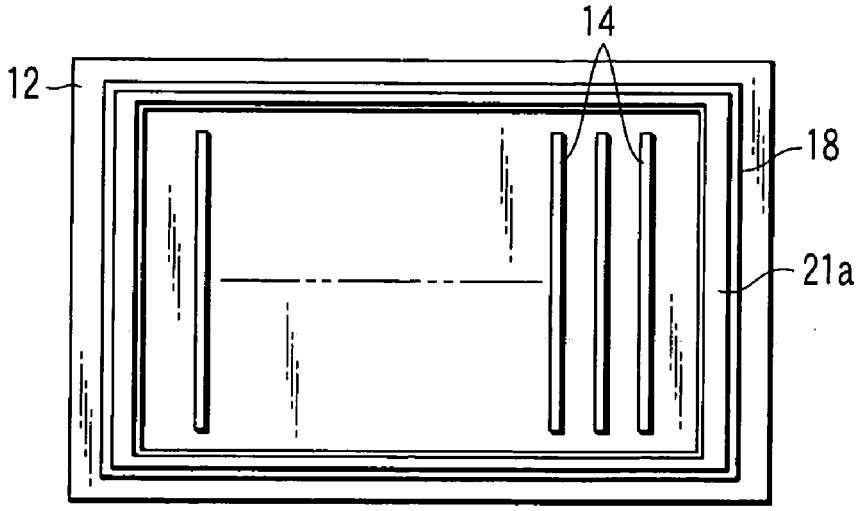
FIG. 17B is a plan view showing a rear substrate which is used in the manufacture of the FED in the second embodiment of the invention.

Subsequently, the side wall 18 and support members 14 are sealed on the inner surface of the rear substrate 12 by a low-melting-point glass 19 in the atmospheric air. As shown in FIG. 17A and FIG. 17B, indium is coated with a predetermined width and thickness on the entire periphery of a sealing surface of the side wall 18, and a sealing layer 21*a* is formed. Similarly, indium is coated in a rectangular-frame shape with a predetermined width and thickness on the entire periphery of a sealing surface of the front substrate 11, which is opposed to the side wall 18, and a sealing layer 21*b* is formed.

Figure 18:
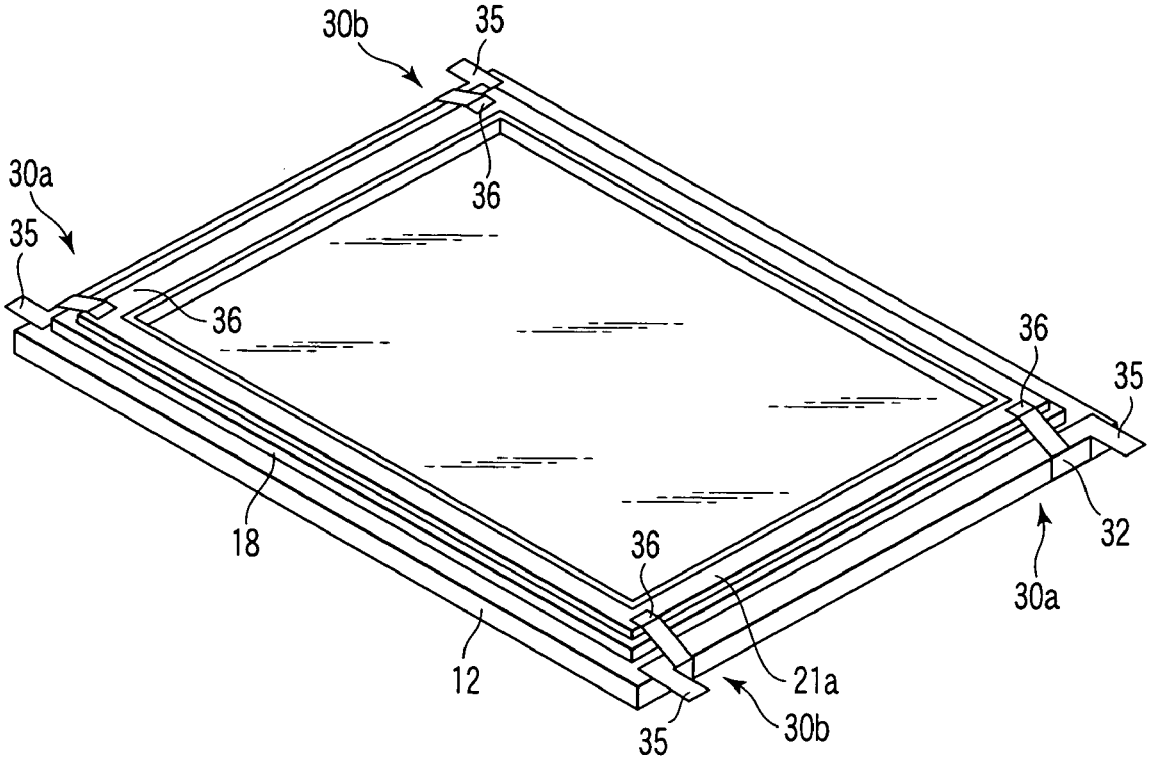
FIG. 18 is a perspective view showing a state in which four electrodes are attached to the rear substrate of the FED.

Subsequently, as shown in FIG. 18, two pairs of electrodes 30*a* and 30*b* are attached to the rear substrate 12 to which the side wall 18 is attached. Each of the electrodes is formed by bending a copper plate with a thickness of, e.g. 0.2 mm as an electrically conductive member. Each electrode integrally comprises a mounting portion 32 which clamps a peripheral part of the rear substrate 12 and thus can be attached thereto, a tongue portion 35 which contacts a power supply electrode to be described later, and a contact portion 36 which can contact the sealing layer 21. The electrodes 30*a* and 30*b* are attached to the corner portions of the rear substrate in the state in which the peripheral edge part of the rear substrate 12 is resiliently clamped by the mounting portions 32. In this case, the contact portion 36 of each electrode 30*a*, 30*b* is put in contact with the indium formed on the side wall 18, and the electrode is electrically connected to the sealing layer 21*a*.

The electrodes 30*a*, 30*b* are used as electrodes for supplying power to the sealing layers 21*a* and 21*b*. It is necessary to provide the paired electrodes 30*a*, 30*b* with a positive (+) polarity and a negative (−) polarity on the substrate, and it is desirable to equalize the lengths of the current paths of the sealing layers through which current is supplied in parallel between the paired electrodes. The paired electrodes 30*a* are mounted near two diagonally opposed corners of the rear substrate 12, and the lengths of the sealing layers, which are positioned between the electrodes 30*a*, are set to be substantially equal on both sides of each electrode. Similarly, the paired electrodes 30*b* are mounted near the other two diagonally opposed corners of the rear substrate 12, and the lengths of the sealing layers, which are positioned between the electrodes 30*b*, are set to be substantially equal on both sides of each electrode.

After the electrodes 30*a*, 30*b* are mounted, the rear substrate 12 and front substrate 11 are spaced apart with a predetermined distance and are opposed. In this state, the resultant structure is put in the above-described vacuum process apparatus 100.

The front substrate 11 and rear substrate 12, which are opposed with a predetermined distance, are first introduced into the load chamber 101. After the load chamber 101 is evacuated, the front substrate 11 and rear substrate 12 are delivered to the baking/electron-beam cleaning chamber 102. In the baking/electron-beam cleaning chamber 102, the various members are heat up to 300° C., and a surface-adsorbed gas on each substrate is released. At the same time, electron beams are emitted from the electron beam generating unit (not shown), which is attached to the baking/electron-beam cleaning chamber 102, to the phosphor screen surface of the front substrate 11 and to the electron emitting element surface of the rear substrate 12. In this case, the electron beams are deflected and scanned by the deflecting device which is mounted on the outside of the electron beam generating unit. Thereby, the entire phosphor screen surface and electron emitting element surface are subjected to electron-beam cleaning.

The front substrate 11 and rear substrate 12, which have been subjected to the electron-beam cleaning, are delivered to the cooling chamber 103, and cooled down to temperatures of about 120° C. Then, the front substrate 11 and rear substrate 12 are transferred to the getter film evaporation deposition chamber 104. In the evaporation deposition chamber 104, a barium film is deposited by evaporation as the getter film 27 on the outside of the metal back 17. The barium film can prevent the surface thereof from being contaminated with oxygen or carbon, and the active state can be maintained.

Figure 19:
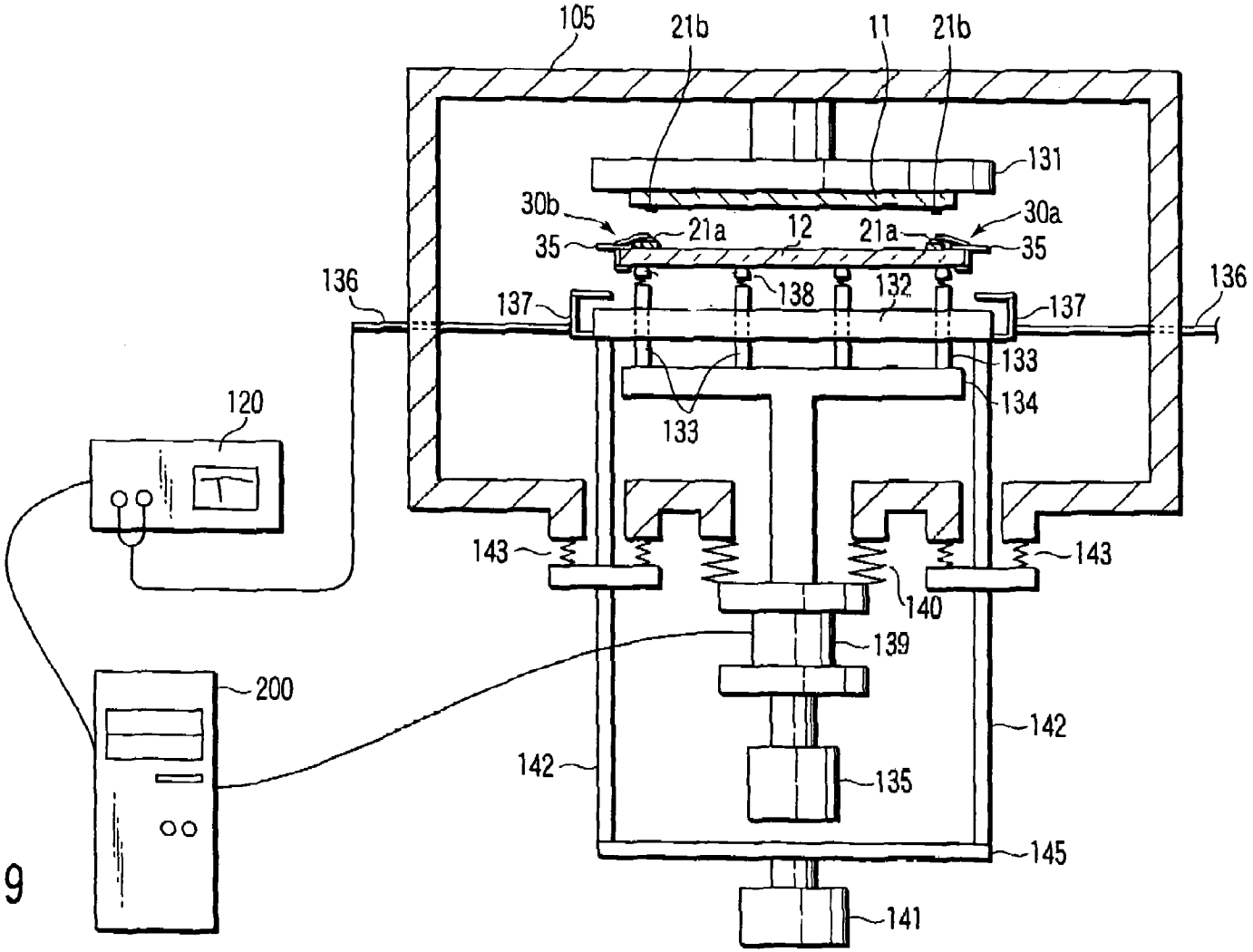
FIG. 19 is a cross-sectional view showing an assembly chamber of a vacuum process apparatus which is used in the manufacture of the FED, and showing a state in which the rear substrate and front substrate, on which the indium is disposed, are disposed to be opposed to each other.

The front substrate 11 and rear substrate 12 are then delivered to the assembly chamber 105. As shown in FIG. 19, in the assembly chamber 105, hot plates 131 and 132 are disposed to be opposed to each other with a gap. A vertically movable stage 134 is provided under the hot plate 132. A plurality of support pins 133 are vertically disposed on the stage 134. A spring 138 is attached to an extension end of each support pin 133. Each support pin 133 is slidably passed through a through-hole formed in the hot plate 132. The support pins 133 can support the rear substrate 12 at their distal ends. The support pins 133 and stage 134 are vertically driven by a motor 135 that is provided on the outside of the assembly chamber 105. The stage 134, support pins 133 and motor 135 constitute a driving mechanism, and also constitute, together with the hot plates 131 and 132, a support mechanism. On the outside of the assembly chamber 105, a load cell 139 which measures a pressure acting on the substrates is disposed via bellows 140.

Figure 20:
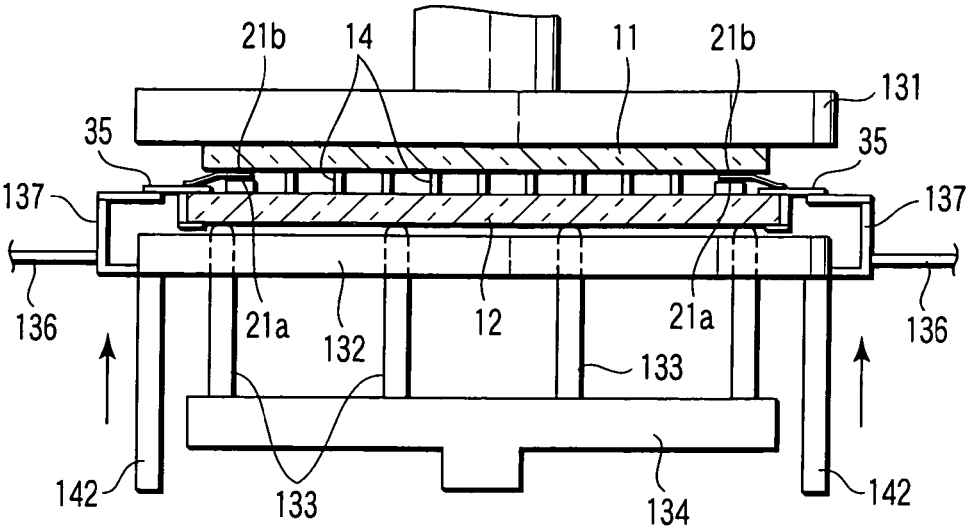
FIG. 20 is a cross-sectional view showing a state in which the front substrate and rear substrate are pressed at the time of sealing.
Figure 21:
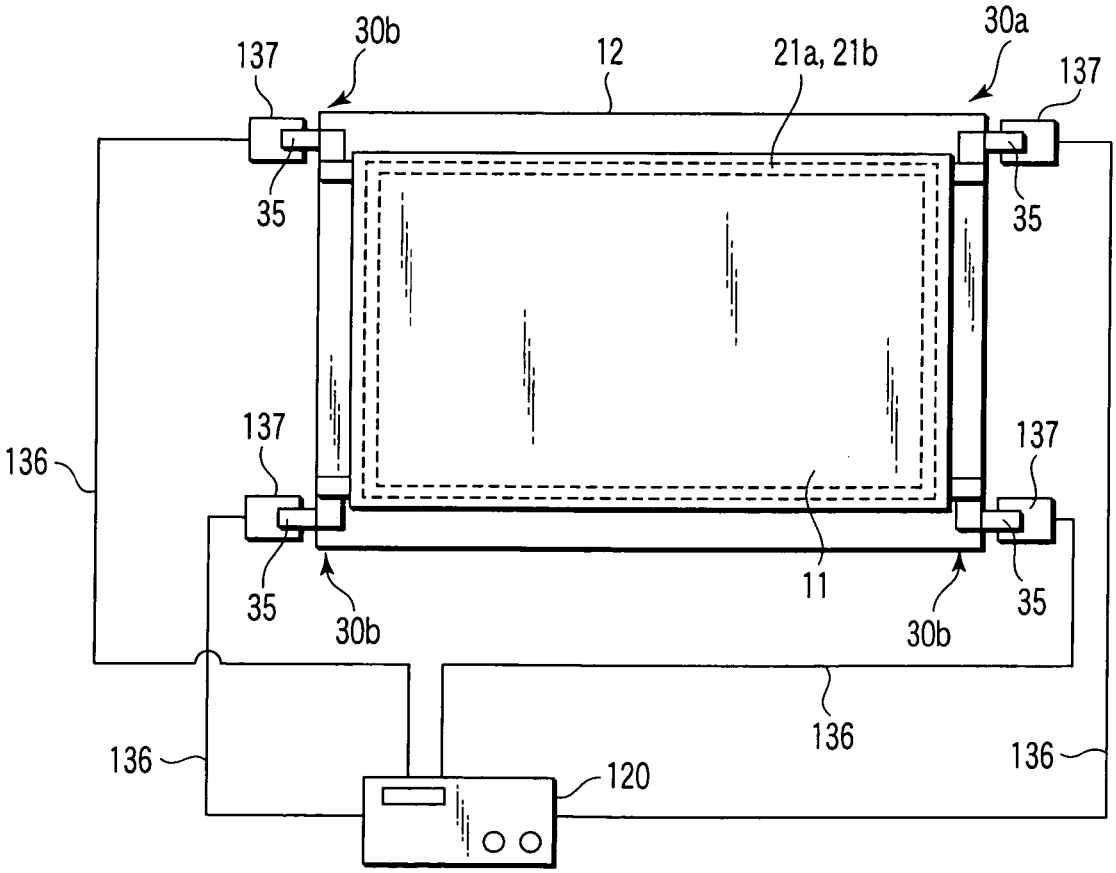
FIG. 21 is a plan view schematically showing the positional relationship between electrodes mounted on the rear substrate and power supply electrodes.

As shown in FIG. 19 to FIG. 21, two pairs of power supply electrodes 137, which contact the tongue portions 35 of the electrodes 30*a* and 30*b* mounted on the rear substrate 12, are provided at end portions of the hot plate 132. Each power supply electrode 137 is electrically connected to the power supply unit 120 via a power supply line 136. Data relating to current and voltage which are supplied to the power supply electrodes 137 from the power supply unit 120 via the power supply line 136, and data relating to pressure, which is output from the load cell 139, are input to the computer 200. The power supply electrodes 137 and power supply unit 120 constitute a power supply mechanism.

As is shown in FIG. 19 and FIG. 20, an elevation plate 145 is provided on the outside of the assembly chamber 105. A motor 141 is connected to the elevation plate 145. The hot plate 132 is connected to the elevation plate 145 via a plurality of shafts 142 and bellows 143. By driving the motor 141, the hot plate 132 can be raised/lowered in a direction toward/away from the other hot plate 131. The hot plate 132, motor 141, shafts 142, elevation plate 145 and power supply electrodes 137 constitute a pushing mechanism, and each power supply terminal constitutes a pushing section.

The front substrate 11 and rear substrate 12, which are transferred to the assembly chamber 105, are first positioned and fixed on the associated hot plates 131 and 132. The front substrate 11 and rear substrate 12 are heated and kept at about 120° C. by the hot plates. After the front substrate 11 is positioned downward, the entire surface of the front substrate 11 is attracted and fixed by the hot plate 131 by a conventional electrostatic attraction technique, and the front substrate 11 is prevented from dropping.

After the front substrate 11 and rear substrate 12 are mutually aligned, the motor 135 is driven to raise the stage 134 and support pins 133. The rear substrate 12 is supported by the support pins 133 and moved toward the front substrate 11. The rear substrate is pressed on the front substrate under a predetermined pressure. In this case, the degree of warp and the amount of the formed indium vary from substrate to substrate, but the springs 138 provided at the distal ends of the support pins 133 can cancel such variation. Thus, any kind of substrate can stably be pressed. By the pressing, the contact portions 36 of the electrodes 30*a* and 30*b* are clamped between the sealing layers 21*b* and 21*a* on the front substrate 11 side and rear substrate 12 side, and the respective electrodes are put in electrical contact with the sealing layers 21*a* and 21*b* of both substrates at the same time. In this case, the pressure acting on the rear substrate 12 is measured by the load cell 139 and the measured value is input to the computer 200.

Thereafter, as shown in FIG. 20 and FIG. 21, the motor 141 is driven to push the hot plate 132 upward, and the power supply electrodes 137 are brought into contact with the electrodes 30*a* and 30*b* from the lower side. In this state, a DC current of 140 A is output from the power supply unit 120 to the paired electrodes 30*a*, and thus the current is supplied in a constant current mode to the sealing layers 21*a* and 21*b* via the power supply line 136, power supply electrodes 137 and electrodes 30*a*. Thereby, the indium is heated and begins to melt. When the indium is melted to a certain degree, the supply of the DC current of 140 A is switched to the other paired electrodes 30*b* and the current is supplied for the same time period. By this alternate power supply, the entire indium can uniformly be melted. Since the pressure is applied to the rear substrate 12 as described above, if the indium melts, the rear substrate 12 is pushed toward the front substrate 11 until the support members 14 provided on the rear substrate completely contact the inner surface of the front substrate 11.

After the power supply for the predetermined period is finished, a signal indicating the end of power supply is sent from the computer 200 to the power supply unit 120, and the power supply to the sealing layer is stopped. For several minutes thereafter, the pressing state is maintained. Thus, the indium is cooled and solidified, and the front substrate 11 and side wall 18 are sealed together by the sealing layer 21. Thereby, the vacuum envelope 10 is formed.

In addition, during the power supply, or after the end of the power supply and before the solidification of the indium, the motor 141 is driven for slight upward pushing and the power supply electrodes 137 push the electrodes 30*a* and 30*b* upward. Thereby, the four corner portions of the rear substrate 12 are pushed toward the front substrate 11 via the electrodes 30*a* and 30*b*, and the warp of the rear substrate 12 due to the power-supply heating of the sealing layer is corrected. No warp occurs on the front substrate 11 since the front surface thereof is attracted and held by the hot plate 131. Therefore, the warp of the substrate can be prevented and the vacuum envelope 10 with uniform thickness can be obtained.

After the sealing, the vacuum envelope 10 is transferred to the cooling chamber 106 and is cooled down to normal temperature, and is then taken out from the unload chamber 107. Thus, the FED is completely manufactured. The electrodes 30*a*, 30*b* may be removed after the sealing.

According to the above-described manufacturing method and manufacturing apparatus of the FED, the surface-adsorbed gas can sufficiently be released by the combination of the baking and electron-beam cleaning, and the getter film with high adsorption performance can be obtained. Since the sealing can be completed in a short time period by the power-supply sealing using the indium, the manufacturing method and manufacturing apparatus with excellent mass-productivity can be obtained. During the power-supply heating of the sealing layer or after the power-supply heating, the four corner portions of the rear substrate 12 are pushed and the warp of the rear substrate 12 is corrected. Thereby, the vacuum envelope with uniform thickness can be obtained. Hence, high air-tightness for vacuum can be maintained over the entire periphery of the vacuum envelope, and the relative position between the electron emitting elements and the phosphor layer can exactly be set over the entire region. Furthermore, when the vacuum envelope is to be attached to a cabinet, etc., the assembly performance can be improved.

In the second embodiment, the power supply is executed in the state in which the front substrate and rear substrate are pressed on each other and the sealing layers are put in contact. Alternatively, after the sealing layer of the front substrate and the sealing layer of the rear substrate are supplied with power and heated and melted, the substrates may be pressed toward each other and sealed together. In this case, the two pairs of electrodes are mounted on the rear substrate, and one pair of electrodes are formed such that their contact portions contact the rear substrate-side sealing layer and the other pair of electrodes are formed such that their contact portions contact the front-substrate-side sealing layer.

In the second embodiment, the electrodes 30*a* and 30*b* are pushed upward by the power supply electrodes 137. Alternatively, the corner portions of the rear substrate may directly be pushed by a pushing mechanism that is separately provided on the assembly chamber 105.

The present invention is not limited directly to the embodiments described above, and its components may be embodied in modified forms without departing from the spirit of the invention. Further, various inventions may be made by suitably combining a plurality of components described in connection with the foregoing embodiments. For example, some of the components according to the foregoing embodiments may be omitted. Furthermore, components according to different embodiments may be combined as required.

In the first and second embodiments, the sealing layers of indium are provided on both the rear substrate side and front substrate side. Alternatively, the sealing layer may be provided on one of the rear substrate side and front substrate side, and in this state the front substrate and rear substrate may be sealed together.

The sealing material is not limited to indium, and may be any other sealing material with electrical conductivity. In general, in the case of metal, a sharp variation occurs in resistance value when the phase of the metal changes, and thus the metal is usable as sealing material. For example, an electrically conductive low-melting-point material, which is usable in place of indium, may be an elemental metal selected from the group consisting of In, Ga, Pb, Sn and Zn, or an alloy including at least one element selected from the group consisting of In, Ga, Pb, Sn and Zn. In particular, it is preferable to use an alloy including at least one element selected from the group consisting of In and Ga, an In metal, or a Ga metal. A low-melting-point sealing material including In or Ga has good wettability with a glass substrate that is formed mainly of $SiO_2$, and is particularly suitable when the substrate, on which the low-melting-point sealing material is to be disposed, is formed of a glass that is formed mainly of $SiO_2$. Preferable low-melting-point sealing materials are an In metal and an alloy including In. Examples of the alloy including In are an alloy including In and Ag, an alloy including In and Sn, an alloy including In and Zn, and an alloy including In and Au. A metal including at least one of In, Sn, Pb, Ga and Bi is usable.

The side wall of the envelope may be formed integral with the rear substrate or front substrate in advance. Needless to say, the outer shape of the vacuum envelope and the structure of the support members are not limited to the above-described embodiments. A matrix-shaped black light absorption layer and phosphor layer may be formed, and sealing may be carried out by aligning columnar support members each having a cross-shaped cross section with the black light absorption layer. A pn-type cold-cathode element or a surface-conduction-type electron emitting element may be used as the electron emitting element. In the above-described embodiments, the substrates are coupled in the vacuum atmosphere, but the invention is applicable in other atmospheric environments.

The present invention is applicable not only to FEDs, but also to other image display devices, such as SEDs and PDPs, and to image display devices in which a high vacuum is not created within envelopes.

What is claimed is:

1. A method of manufacturing an image display device having an envelope including a front substrate and a rear substrate, comprising:

forming a sealing layer by disposing an electrically conductive sealing material on a peripheral edge part of at least one of the front substrate and the rear substrate;

disposing the front substrate and the rear substrate such that the front substrate and the rear substrate are opposed to each other;

forming a current path in the sealing layer, beginning power supply to the sealing layer, and supplying an electric current, which reaches a maximum current value after a current-increasing period of 10% or more of an entire power-supply time, for a predetermined time period; and heating and melting the sealing layer by the electric current supply and bonding the peripheral parts of the front and rear substrates together with the molten sealing layer.

2. The method of manufacturing an image display device according to claim 1, wherein the sealing layer is heated and melted with a current having a maximum current value of 200 amperes or more.

3. The method of manufacturing an image display device according to claim 1, wherein a current control unit capable of varying the current-increasing period up to 100% at maximum is provided, and the current-increasing period is voluntarily set.

4. The method of manufacturing an image display device according to claim 1, wherein a pair of electrodes which supply power for heating and melting the sealing layer are disposed at two opposed positions on a peripheral edge part of the substrate such that the electrodes are capable of contacting the sealing layer.

5. The method of manufacturing an image display device according to claim 1, wherein each of a pair of electrodes, which supply power to the sealing layer of the front substrate, and a pair of electrodes, which supply power to the sealing layer of the rear substrate, are disposed at two opposed positions on a peripheral edge part of the associated substrate such that the two opposed positions on the substrate differ from the two opposed positions on the other opposed substrate.

6. A method of manufacturing an image display device having an envelope including a front substrate and a rear substrate, comprising:

forming a sealing layer by disposing an electrically conductive sealing material on a peripheral edge part of at least one of the front substrate and the rear substrate;

attaching to the sealing layer a pair of electrodes which supply power for heating and melting the sealing layer, and forming a current path for the power supply in the sealing layer;

disposing the front substrate and the rear substrate such that the front substrate and the rear substrate are opposed to each other, and pressing the front substrate and the rear substrate toward each other;

beginning power supply to the sealing layer via the electrodes in the state in which the front substrate and the rear substrate are pressed;

supplying an electric current, which reaches a maximum current value after a current-increasing period of 10% or more of an entire power-supply time, for a predetermined time period; and heating and melting the sealing layer by the power supply to bond a peripheral part of the front substrate and a peripheral part of the rear substrate to each other.

7. A method of manufacturing an image display device having an envelope including a front substrate and a rear substrate which are disposed to be opposed to each other and are joined at peripheral parts thereof, the method comprising:

forming sealing layers on the front substrate and the rear substrate by disposing electrically conductive sealing materials on peripheral edge parts of mutually opposed surfaces of the front substrate and the rear substrate;

attaching, to each of the sealing layer of the front substrate and the sealing layer of the rear substrate, a pair of electrodes which supply power for heating and melting the associated sealing layer, and forming current paths for the power supply in the sealing layer of the front substrate and the sealing layer of the rear substrate;

beginning power supply to the sealing layers via the electrodes, and supplying an electric current, which reaches a maximum current value after a current-increasing period of 10% or more of an entire power-supply time, for a predetermined time period;

heating and melting the sealing layer of the front substrate and the sealing layer of the rear substrate by the power supply;

pressing the front substrate and the rear substrate toward each other in the state in which the front substrate and the rear substrate are opposed to each other; and bonding the peripheral parts of the front substrate and rear substrates to each other.

8. The method of manufacturing an image display device according to claim 7, wherein each of the sealing layers is heated and melted with a current having a maximum current value of 100 amperes or more.

* * * * *